US006051923A

United States Patent [19]

Pong

[11] Patent Number: 6,051,923

[45] Date of Patent: Apr. 18, 2000

[54] MINIATURE ELECTRON EMITTER AND RELATED VACUUM ELECTRONIC DEVICES

[76] Inventor: Ta-Ching Pong, 3F, No. 36, Lane 21, Lungchiang Rd., Taipei, Taiwan

[21] Appl. No.: 08/982,635

[22] Filed: Dec. 2, 1997

[51] Int. Cl.[7] ..... H01J 63/04

[52] U.S. Cl. ..... 313/495; 313/496; 313/512

[58] Field of Search ..... 313/496, 495, 313/309, 312, 336, 351, 422, 308, 310, 304, 512, 497, 306, 293, 284, 248, 249, 251

[56] References Cited

U.S. PATENT DOCUMENTS 4,577,133 3/1986 Wilson ..... 313/422
4,950,946 8/1990 Van Der Wilk ..... 313/422
5,289,078 2/1994 Kitao et al. ..... 313/308
5,621,272 4/1997 Levine et al. ..... 313/497

*Primary Examiner*—Nimeshkumar D. Patel
*Assistant Examiner*—Joseph Williams
*Attorney, Agent, or Firm*—William E. Pelton, Esq.

[57] ABSTRACT

A miniature electron emitter is disclosed. The miniature electron emitter includes a substrate, a first pattern of electrical conductor formed upon the substrate and a second pattern of electrical conductor insulatedly arranged to the first pattern of electrical conductor. An electron emitting part is electrically ohmic connected to the first pattern of electrical conductor and the second pattern of electrical conductor. A dielectric layer may also be mounted on the electron emitting part. A vacuum electronic device comprising the miniature electron emitter is also disclosed.

16 Claims, 5 Drawing Sheets

MINIATURE ELECTRON EMITTER AND RELATED VACUUM ELECTRONIC DEVICES

The present invention relates to a miniature electron emitter. More particularly, the present invention relates to a vacuum electronic device comprising the miniature electron emitter, which can be used in a thin display device, and to the methods of constructing the miniature electron emitter and the vacuum electronic device. Additionally, the present invention also relates to a light emitting device.

BACKGROUND OF THE INVENTION

Conventionally, a liquid crystal display (LCD) is a very popular thin display device. However, an LCD faces the difficulties of complexity in the manufacturing process and the need of external lighting for contrast and color. These difficulties have traditionally inhibited the development of the LCD device being considered in manufacturing a larger area display. The projection display TV is another example of a thin display device. However, the projection display TV still has the drawbacks that the projection machine per se is also too bulky, and the contrast of color is too low for effective use. The plasma display panel is still another example of a thin display device. However, the plasma display panel has the drawbacks of scanning-dependent luminance and needing a higher voltage of driving circuitry, which inhibit its use in terms of the complexity of constructing and cost. The field emission display device is also another example of a thin display device. The field emission display device uses field emission cathodes which are complex in manufacturing, and thus is limited in the area of producing larger display devices.

Although numerous thin display devices have already existed, there is still a need to provide a thin display device with the benefits of low cost and ease in manufacturing.

SUMMARY OF THE INVENTION

One object of the present invention is to provide a miniature electron emitter.

Another object of the present invention is to provide a method of manufacturing the miniature electron emitter, which is economic because of low driving voltage circuitry required, and can achieve an effective display area size that is difficult to be made by traditional methods of manufacturing planar display devices.

Yet another object of the present invention is to provide a miniature electron emitter, comprising a substrate a first pattern of electrical conductor formed upon the substrate;

a second pattern of electrical conductor insulatedly arranged to the first pattern of electrical conductor;

an electron emitting part being electrically ohmic connected to the first pattern of electrical conductor and the second pattern of electrical conductor; and a dielectric layer formed on the electron emitting part, if desired.

Still another object of the present invention is to provide a vacuum electronic device, comprising:

an electron emitting plate, wherein numerous miniature electron emitters indicated are above arrayed thereon, and a face plate.

Another object of the present invention is to provide a light emitting device which comprises a light source plate and a filter plate.

BRIEF DESCRIPTION OF THE DRAWINGS

For a further understanding of the present invention, reference may be had to the accompanying drawings in which.

DETAILED DESCRIPTION OF THE PREFERRED EMBODIMENTS

Figure 1:
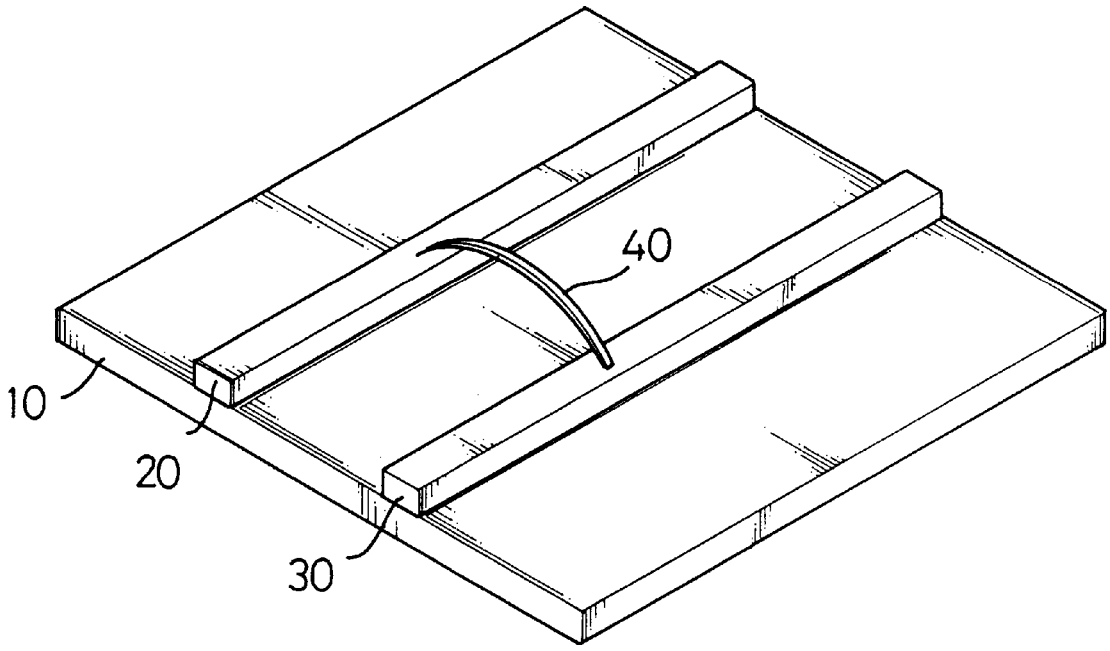
FIG. 1 is a perspective view of one embodiment of a miniature electron emitter of the present invention.
Figure 2:
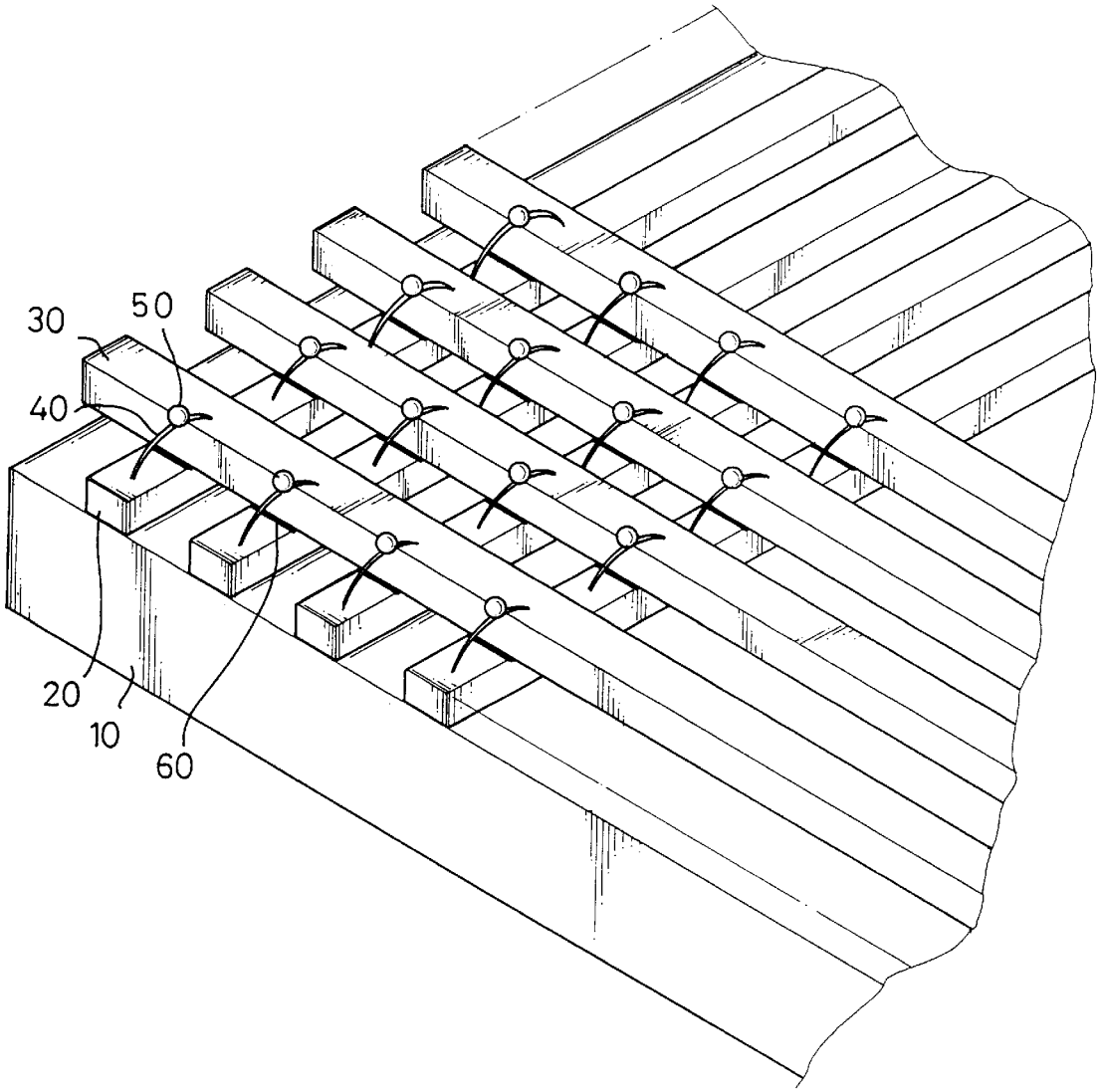
FIG. 2 is a partial perspective view of another embodiment of the present invention.

Referring to FIG. 1, a preferred embodiment of the present invention includes a substrate 10, a first pattern of electrical conductor 20 formed upon the substrate 10, a second pattern of electrical conductor 30 insulatedly arranged to the first pattern of electrical conductor 20, and an electron emitting part 40 being electrically ohmic connected to the first pattern of electrical conductor 20 and the second pattern of electrical conductor 30. If desired, the electron emitting part 40 may have formed thereon a dielectric layer 50, as shown in FIG. 2, with reference to FIG. 2, another embodiment of the present invention includes a substrate 10, a first pattern of electrical conductor 20 formed upon the substrate 10, a second pattern of electrical conductor 30, an insulator 60 disposed between the first pattern of electrical conductor 20 and the second pattern of electrical conductor 30, and an electron emitting part 40 being electrically ohmic connected to the first pattern of electrical conductor 20 and the second pattern of electrical conductor 30. If desired, the electron emitting part 40 may have formed thereon a dielectric layer 50.

The substrate 10 is a transparent, semitransparent, translucent or opaque flat plate, and is made of ceramics, plastics, metals or insulated metals, preferably of glass. The first pattern of the electrical conductor 20 is chosen depending on the thermal expansion coefficient and electrical resistivity of the used materials. Preferably, the first pattern of electrical conductor 20 is made of gold, copper, nickel-plated copper, copper-nickel alloy (50/50) or copper-chromium-ferrous alloy (42/6/52), or the like. The thickness of the first pattern of electrical conductor 20 is determined depending on the desired display area. Additionally, the thickness of the first pattern of electrical conductor 20 is also dependent on the resulting R-C constant of the particular construction. The shape of the first pattern of electrical conductor 20 can be in a line, dot or any other suitable shape. In practice, the first pattern of electrical conductor 20 has a thickness of 0.001 mm to 1 mm.

The first pattern of electrical conductor 20 is applied over the surface of the substrate 10 by evaporation, sputtering, or even by using etched metal then glass-frit or conductive thick-film paste being fixed.

The insulator 60 may be a variety of dielectric breakdown materials. The thickness of the insulator 60 depends on the method of preparation and the desired driving circuitry, and usually ranges from 0.001 mm to 1 mm. Preferably, the insulator 60 is a $SiO_2$-based thick-film dielectric insulator paste, evaporated or sputtered $Si_3N_4$, or the like.

The second pattern of electrical conductor 30 is also chosen depending on the thermal expansion coefficient and electrical resistivity of the used materials. Preferably, the second pattern of electrical conductor 30 is made of gold, copper, nickel-plated copper, copper-nickel alloy (50/50) or copper-chromium-ferrous alloy (42/6/52) or the like. The thickness of the second pattern of electrical conductor 30 is also determined depending on the desired display area. The thickness of the second pattern of electrical conductor 30 increases proportionally with the size of the display area. Additionally, the thickness of the second pattern of electrical conductor 30 is also dependent on the resulting R-C constant of the particular construction. The shape of the second pattern of electrical conductor 30 can be in a line, dot or any other suitable shape. In practice, the second pattern of electrical conductor 30 has a thickness of 0.001 mm to 1 mm.

The second pattern of electrical conductor 30 is applied over the surface of the insulator 60 by evaporation, sputtering, or even by using etched metal then glass-frit or conductive thick-film paste being fixed.

The electron emitting part 40 may be in a shape of cantilever, arch, line, dot, zigzag or any shape which can link the first pattern of electrical conductor 20 and the second pattern of electrical conductor 30. The electron emitting part 40 may be of any materials having suitable surface work function, such as refractory metals, e.g. tungsten, tungsten alloys, molybdenum or molybdenum alloys, tungsten or tungsten alloys modified with thorium, cesium, barium or lanthanum, or alloys thereof or the like.

The dielectric layer 50 is optionally formed on the electron emitting part 40 so as to reduce the surface work function of the electron emitting part 40. The material which can be used as the dielectric layer 50 is selected based on the required electron emission density, and is selected from a group consisting of suitable cathodes or cold cathodes materials, such as carbon, strontium, alkaline earth carbonates, and the like.

When suitable electric energy is fed through the first pattern of electrical conductor 20, via the electron emitting part 40, to the second pattern of electrical conductor 30, and vice versa, a free electron stream is emitted from the surface of the electron emitting part 40 with a suitable desired density. Due to the electron emitting part 40 being constructed in a shape of zigzag or any shape which can increase the surface area of the electron emitting part 40, the required electrical energy, thus the required driving voltage and current, can be optimized to give sufficient free electron streams.

Figure 3:
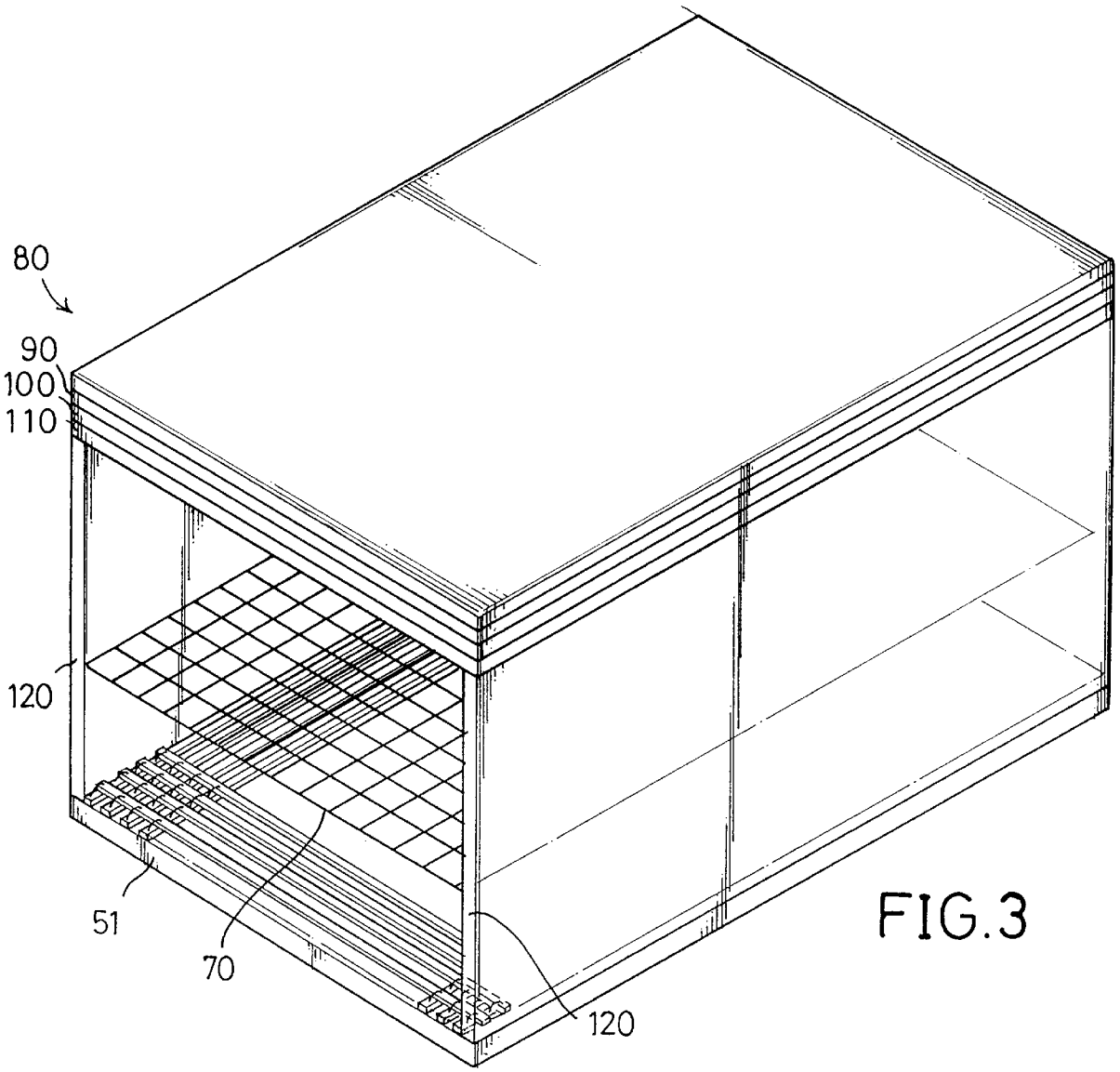
FIG. 3 is a perspective view of yet another embodiment of the present invention.
Figure 4:
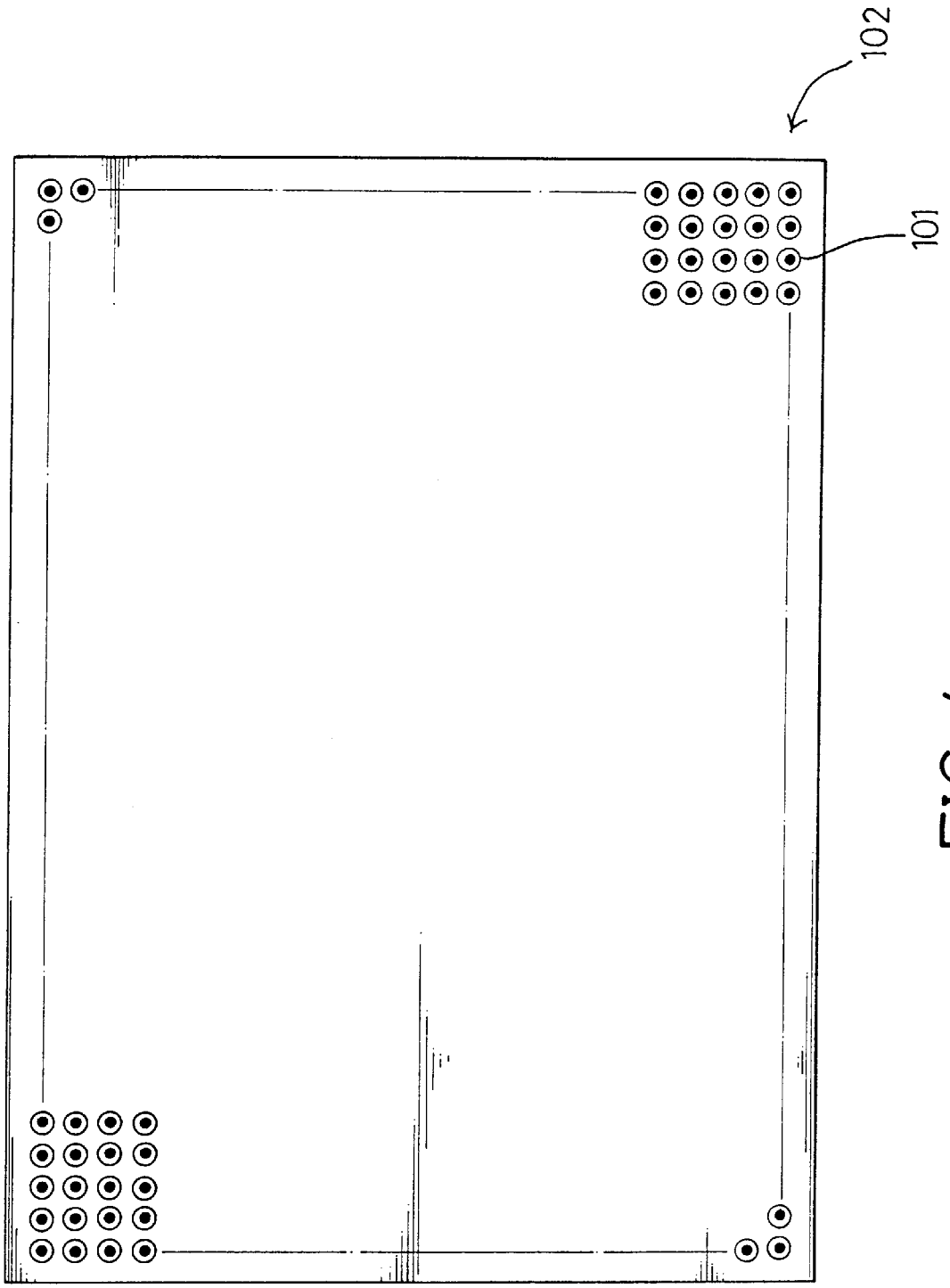
FIG. 4 is an elevated planar view of a fluorescent layer for use in connection with the present invention.

The present invention also relates to a vacuum electronic device. FIG. 3 shows an embodiment of the vacuum electronic device according to the present invention. The vacuum electronic device essentially comprises a planar electron emitting plate 51 with numerous above mentioned miniature electron emitters arrayed in a matrix thereon and a face plate 80 in vacuumed packing with suitable sealing materials 120. The face plate 80 is a thin transparent or semitransparent ceramic plate. A thin transparent electrode 90 is formed on a side of the face plate 80. The thin transparent electrode 90 is made of indium tin oxide which is well known in the field of flat panel display devices. Additionally, a fluorescent layer 100 is optionally formed over the face plate 80 above the thin transparent electrode 90. The materials which can be used as the fluorescent layer 100 are well known to the field of CRT and other display devices. Preferably, the material which can be used as the fluorescent layer 100 is selected from the group consisting of ZnO, $Y_2SiO_5$, $Sr_3(PO_4)_2$, $Ba_3(PO_4)_2$, $CaWO_4$, $ZnSiO_4$ or $Y_2O_2S$ or the like. The fluorescent layer 100 is chosen to give rise to different photon emission spectra. The main spectrum center can be chosen to suitably fit into the CIE chromatic standard to give excellent color display devices. A single photon emission spectrum center can also be chosen to give rise to desired monochrome display devices. Furthermore, a metal grid 70 may be disposed between the electron emitting plate 51 and the face plate 80 so as to accelerate the electrons. Additionally, a suitable semitransparent thin metal sheet 110 can be optionally formed over the fluorescent layer 102. Preferably, the semitransparent thin metal sheet 110 is made of aluminum. Referring to FIG. 4, the fluorescent layer 102 is separated into independent fluorescent areas with different photon emission spectra by a black matrix 101 having an optical density of at least 1.0. The black matrix 101 is well known in the field of displays, and can be a photo sensitive polymer with black color dye, thin chromium film etc. The thickness of the black matrix 101 depends on the desired optical density and the required electro-optical characteristics.

Further referring to FIG. 3, the number of the miniature electron emitters required to be arrayed on the electron emitting plate 51 depends on the desired resolution, such as 640×480, 1600×1200 etc. The control of determining which miniature electron emitter on the electron emitting plate 51 should be conducted is known in the art of flat display devices, such as LCD. The sealing material 120 is glass soldering compounds or glass-frit which is put around the periphery of either the face plate 80 or the electron emitting plate 51 during packing. Then, the face plate 80 and the electron emitting plate 51 are brought into contact with each other through the sealing materials 120, and are put through a high temperature process to hermetically seal the face plate 80 and the electron emitting plate 51.

Prior to the high temperature sealing process, suitable separation between the face plate 80 and the electron emitting plate 51 is maintained via a non-conducting separator which is prepared either in-between or around the face plate 80 and the electron emitting plate 5. Preferably, the face plate 80 and the electron emitting plate 51 are separated via an in-between non-conducting separator so as to keep a fairly constant distance therebetween. The thickness of the non-conducting separator is chosen depending on the desired electro-optical characteristics of the display devices and the complexity of the method of constructing the vacuum electronic device.

A suitable getter material is also optionally prepared between the face plate 80 and the electron emitting plate 51 prior to the sealing process. The getter material can be, for example, Hg—Ti, $Ba/Sr(Co_3)$, etc. The getter material can exist in a form of a pellet, a rod, etc.

After the sealing process is completed, the space defined by the face plate 80 and the electron emitting plate 51 is vacuumed by a vacuuming process. The resulted pressure is preferably between 1 torr to 1000 torr. Finally, the space defined by the face plate 80 and the electron emitting plate 51 can be optionally filled with suitable Penning gas. Examples of the Penning gas are Ne—Xe, He—Xe, Ar—Xe, etc.

Figure 5:
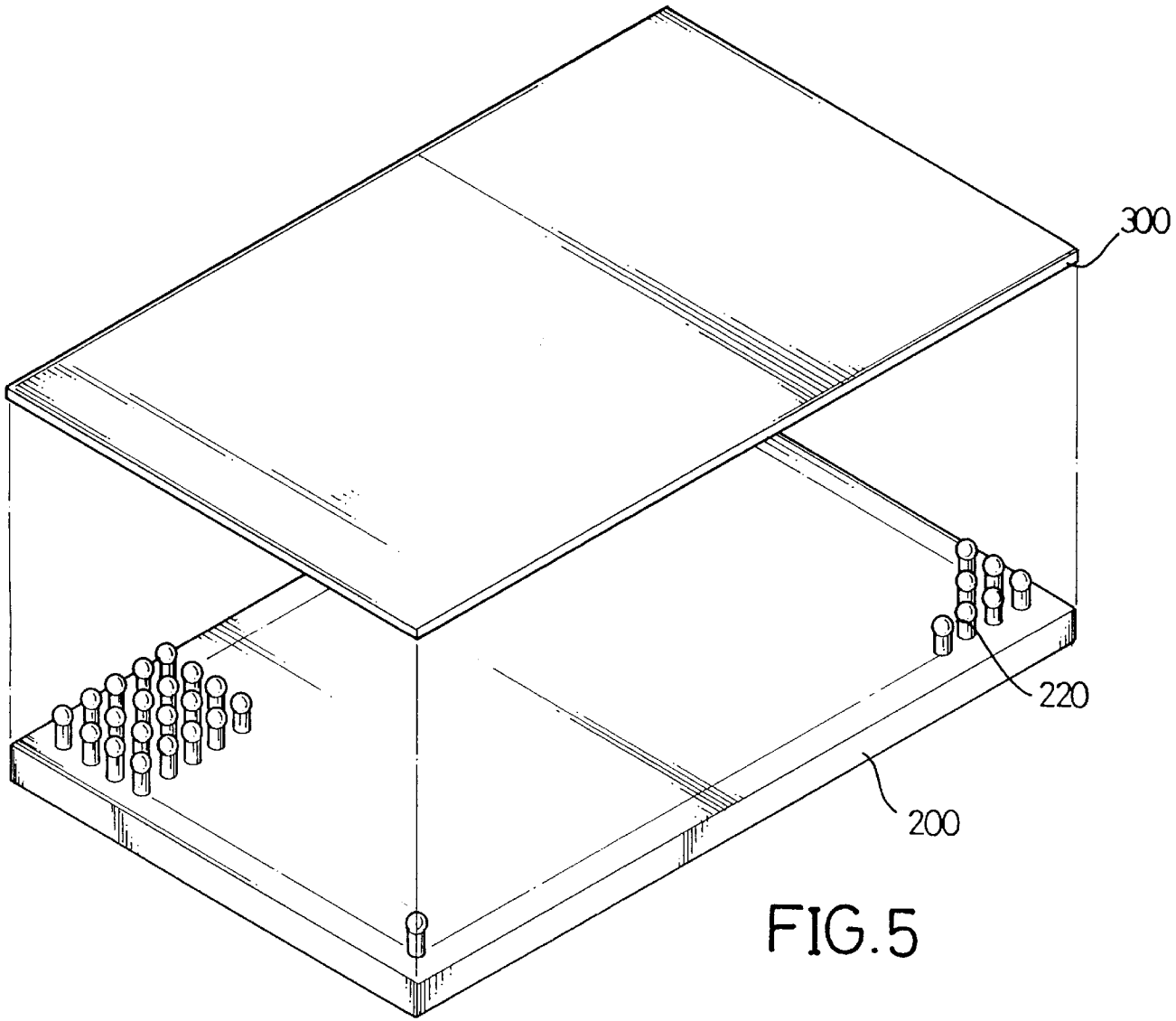
FIG. 5 is a perspective view of still another embodiment of the present invention.

Referring to FIG. 5, another embodiment of the present invention is to provide a light emitting device which comprises a light source plate 200 and a optional filter plate 300. The light source plate 200 comprises numerous light sources 220 arrayed in a grid thereon. The light source 220 is basically comprised the same as the electron emitter as described above. The materials used are replaced by materials well-known in the field of electrical bulbs, such as an incandescent bulb, a halogen bulb, etc. The space defined by the light source plate 200 and the filter plate 300 is filled with a suitable rare gas as is well known to the bulb industry. When proper energy is supplied to the above mentioned emitter construction, thermal incandescent light can be emitted. The filter plate 300 is composed of a plurality of filters with suitable photo spectra characteristics which are positionedly corresponding to the light source 220. By means of the control of the conducting of the light sources 220, an image can be seen from the filter plate 300.

Another embodiment of the present invention is that the present miniature electron emitter is used in a triode, wherein numerous metal plates are correspondingly arranged to the planar electron emitting plate 5.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

What is claimed is:

1. A miniature electron emitter, comprising:

a substrate;

a first pattern of electrical conductor formed upon said substrate;

a second pattern of electrical conductor insulatedly arranged to said first pattern of electrical conductor;

an electron emitting part being electrically ohmic connected to said first pattern of electrical conductor and said second pattern of electrical conductor; and a dielectric layer mounted on the electron emitting part.

2. The miniature electron emitter of claim 1, wherein the first pattern of conductor has a thickness from 0.001 mm to 1 mm depending on a display area, and is made of gold, copper, nickel-plated copper, copper-nickel alloy (50/50), or copper-chromium-ferrous alloy (42/6/52).

3. The miniature electron emitter of claim 1, wherein the thickness of the first pattern of conductor is chose depending on the resulting R-C constant of shape of the first pattern of conductor.

4. The miniature electron emitter of claim 1, wherein the second pattern of conductor has a thickness from 0.001 mm to 1 mm depending on a display area, and is made of gold, copper, nickel-plated copper, copper-nickel alloy (50/50), or copper-chromium-ferrous alloy (42/6/52).

5. The miniature electron emitter of claim 1, wherein the thickness of the second pattern of conductor is chosen depending on the resulting R-C constant of shape of the second pattern of conductor.

6. The miniature electron emitter of claim 1, wherein the electron emitting part is in a shape of cantilever, and has a thickness from 0.001 mm to 1 mm, and is made of refractory metals selected from a group consisting of tungsten, tungsten alloys, molybdenum or molybdenum alloys, tungsten or tungsten alloys modified with thorium, cesium, barium or lanthanum, or alloys thereof.

7. The miniature electron emitter of claim 1, wherein the electron emitting part is in shape a line, dot, or zigzag.

8. The miniature electron emitter of claim 1, wherein the dielectric layer is selected depending on a required electron emission density, and selected from a group consisting of cathode or cold cathode materials, such as carbon, strontium, alkaline earth carbonates.

9. A vacuum electronic device, comprising:

a electron emitting plate, where a plurality of the miniature electron emitters according to claim 1 are arrayed thereon, and a face plate, wherein a fluorescent layer is formed over a surface of the face plate facing the miniature electron emitter;

a space defined by the miniature electron emitter and the face plate being vacuumed and sealed.

10. The vacuum electronic device of claim 9, wherein the face plate is a thin transparent or semitransparent ceramic plate.

11. The vacuum electronic device of claim 9, wherein the fluorescent layer is separated into independent fluorescent areas with different photon emission spectra by a black matrix.

12. The vacuum electronic device of claim 11, wherein the black matrix is a photo sensitive polymer and has an optical density of at least 1.0.

13. The vacuum electronic device of claim 9, wherein the miniature electron emitter and the face plate are assembled in a substantially flat state.

14. A light emitting device, comprising a substrate plate having a plurality of light sources arrayed in a grid thereon, and a filter plate composed of a plurality of filters with suitable photo spectra characteristics which are positioned corresponding to the light sources.

15. The light emitting device of claim 14 in which said filters are arrayed in a grid corresponding to the grid of said light sources.

16. The light emitting device of claim 14 in which said filter plate is positioned over and spaced from said substrate plate, the space between said plates being filled with a rare gas.

* * * * *